United States Patent [19]

Boyadjian

[11] 4,228,830

[45] Oct. 21, 1980

[54] METHOD AND DEVICE FOR MANUFACTURING A SINGLE-PIECE BINDER WITH A HANGER FOR SHEET PACKS

[76] Inventor: Hratch Boyadjian, Seestrasse 19, CH-8703 Erlenbach, Switzerland

[21] Appl. No.: 25,086

[22] Filed: Mar. 29, 1979

[30] Foreign Application Priority Data

Apr. 5, 1978 [CH] Switzerland ..... 3634/78

[51] Int. Cl.[3] ..... B21F 35/02

[52] U.S. Cl. ..... 140/102; 140/92.7; 140/104; 11/1 R

[58] Field of Search ..... 140/71 R, 92.3, 92.4, 140/92.7, 102, 103, 104, 105; 11/1 R, 1 AC; 72/137

[56] References Cited

U.S. PATENT DOCUMENTS

| | | | |
|---|---|---|---|
| 1,906,449 | 5/1933 | Dedrick et al. | 140/103 |
| 2,161,689 | 6/1939 | Strandberg | 140/102 |
| 3,342,223 | 9/1967 | Hall et al. | 140/102 |
| 3,685,062 | 8/1972 | Pearson | 140/92.7 |

*Primary Examiner*—Lowell A. Larson
*Attorney, Agent, or Firm*—McGlew and Tuttle

[57] ABSTRACT

A device for forming a hanging eye in a wire binder, having a plurality of loops extending through a stack of sheets adjacent one edge of the sheets with the recess formed in the edge, comprising, a housing, a pair of tongs pivotally mounted in the housing, forming a jaw for grasping one of the loops in the binder, and a first driver for closing and opening the tongs to grasp and release the loop. The frame is movable to bring the jaw into the vicinity of the recess with the first driver being energized to grasp a loop adjacent the recess in the jaw. A second driver is connected to the tongs for rotating them about 90° to rotate the grasped loop adjacent the recess. The first driver is then energized to open the jaws and the second driver is energized to remove the jaws from the vicinity of the recess. A hanging eye is thus formed from the loop which has been rotated through 90° in a continuous operation. The invention is also drawn to a method for producing a hanging eye in a continuous wire binder.

17 Claims, 16 Drawing Figures

19
20
11
13b
10a
13a
21
10
8
9
14
19
18
10
15a
16
18a
23
23b
22
23a
15

34
44
43
35
36
33
37
32
31
38
45
31a
31b
47
40
41
46

METHOD AND DEVICE FOR MANUFACTURING A SINGLE-PIECE BINDER WITH A HANGER FOR SHEET PACKS

FIELD AND BACKGROUND OF THE INVENTION

The present invention relates to wire binders of the spiral, double loop or similar kind in general and, in particular, to a new and useful method and device for manufacturing a single-piece binder with a hanging eye using an automatic device and in a continuous method.

DESCRIPTION OF THE PRIOR ART

Various wire bindings are known in which a single length of wire is bent into a plurality of loops, each of which extend through a stack of sheets to be bound together adjacent an edge thereof to form a continuous binder. The wire can be bent into a helical shape, each turn of which forms a loop of the binder or, alternatively, the continuous wire may be formed into a plurality of double loops forming hooks for extending through the sheet stack.

These structures are exemplified by Swiss Patent No. 588,356, which is incorporated, by reference, in the specification. These binders are manufactured on known and conventional machines. A hanging eye may be formed near the middle of such binders by grasping one or more loops in the binder and rotating it substantially into the plane of the sheet pack. Such an operation, if performed manually, results in hanging eyes which are inconsistent in shape and configuration and inaccurately located. Further, a manual method is not adapted for series mass production.

SUMMARY OF THE INVENTION

The present invention is drawn to a device and method for automatically forming a hanging eye in continuous wire bindings in automatic and rapid succession, without sacrificing accuracy in the formation of the eye or location thereof.

To this end, in accordance with the invention, a method is provided for manufacturing an integral binder for sheet packs having a single length of wire forming a plurality of loops passing through holes provided near an edge of the sheet pack and having at least one hanger eye formed from at least one loop of the binder and located in the vicinity of a recess provided in the edge, comprising, introducing the loops of the binder through holes provided in the sheet pack, mechanically grasping at least one loop in the vicinity of the recess in the sheet pack edge, rotating the loops approximately 90° and sufficiently to turn the loop to form the hanger eye, releasing the loop thus turned and removing the mechanical devices used to grasp the loop in a direction perpendicular to the edge. In this regard, it is advantageous to provide a relatively small recess in the edge of the sheet pack which, for example, encompasses only three loops. This restricted recess prevents the undermining of the binder and, at the same time, provides sufficient room for the turning of the grasped loops to form the hanger eye.

The device of the invention comprises a frame, a pair of tongs movably mounted within the frame to form a grasping jaw for grasping at least one loop in the binder in the area of the recess with the pair of tongs being rotatably mounted within the frame, first drive means for opening and closing the jaw formed by the tongs to release and grasp at least one loop in the binder, means for moving the frame to move the jaw formed by the tongs perpendicularly into the vicinity of the recess and means for rotating the pair of tongs through 90° to rotate the grasped loops and form the hanger eye.

In a particularly advantageous method in which the wire helix is used, the helix is introduced into the holes in the back or edge of the sheet pack at a working station where the ends of the wire helix are bent inwardly by means of lateral bending tools and the wire helix is fixed in its angular position relative to the sheet pack by applying these ends to one side of the sheet pack, with the turns of the wire helix adjacent the recess of the sheet pack being axially fixed by means of a comb moved in, perpendicularly to the axis of the wire helix, while, at the same time, the tongs moved down in an open position, in the direction of the wire helix engages over the turn or loop extending in the zone of the recess in the back, clamps the turn or loop and twists it through 90° and then, in an open position, is again lifted, as is the comb, whereupon, the bound sheet pack is removed from the eye-forming station.

If the binding comprises a wire length which is bent out of the wire axis at spaced locations and in a hook-like manner to form open loops, a particularly advantageous method, in accordance with the invention, is characterized in that the sheet pack provided with the wire structure is moved, for example, to a horizontal supporting table at the eye-forming station and, at the same time, the wire structure with its loops is turned about its axis until the wire link portions connecting the loops adjacent the recess in the back apply, at the underside or top of the sheet pack, against a stop by which the wire structure is fixed in this angular position.

The tongs of the tongs mechanism, which has been lowered in an open position, in a direction perpendicularly to the axis of the wire structure then engages over the loop extending in the zone of the recess in the back edge, clamps it firmly and turns it through 90° and then, in the open structure, whereupon, the bound sheet pack is removed from the eye-forming station.

Another object of the invention is to provide a device for forming a hanging eye in a wire binder which is simple in design, rugged in construction and economical to manufacture.

The various features of novelty which characterize the invention are pointed out with particularly in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
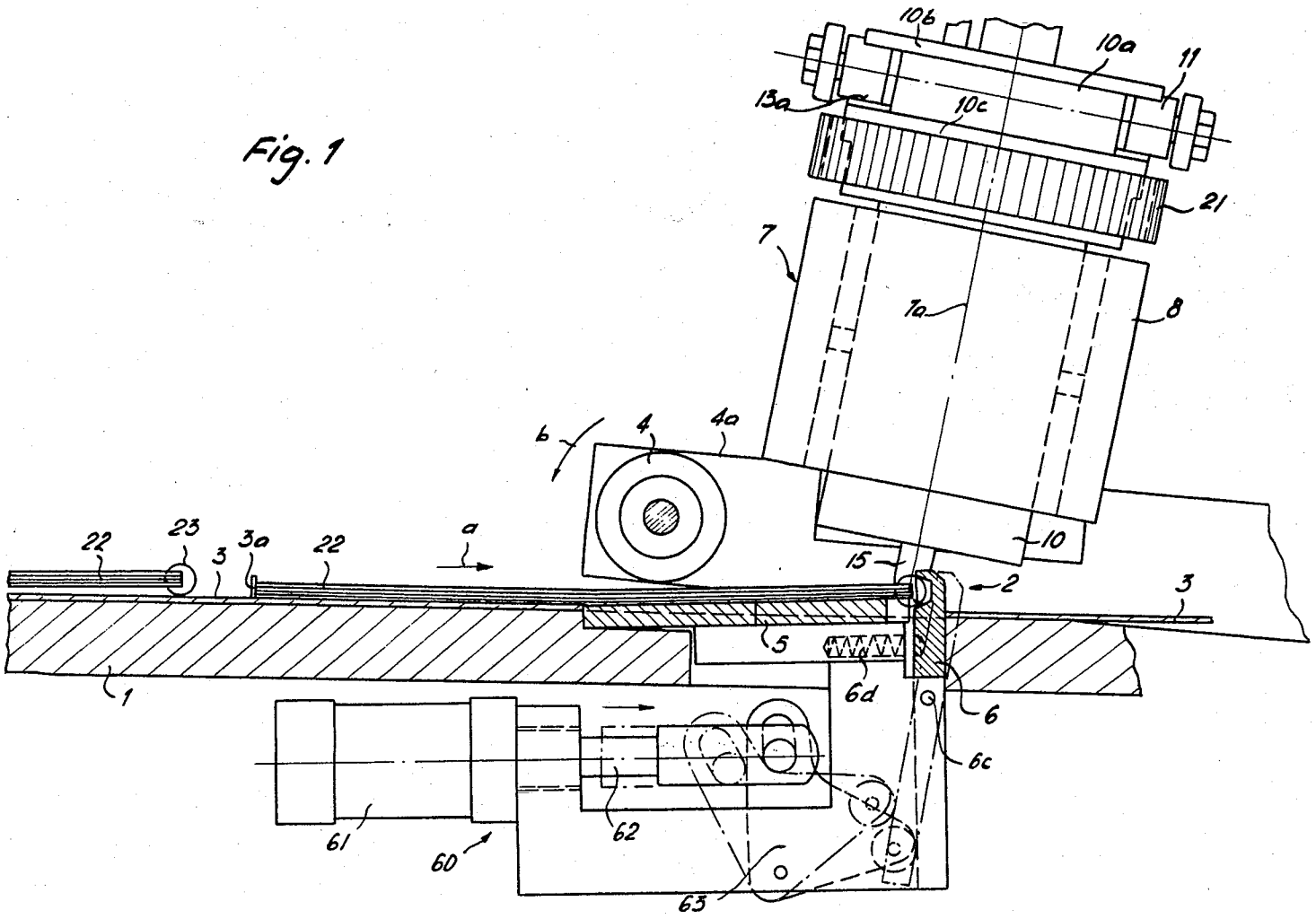
FIG. 1 is a side elevational view of the feeding and aligning mechanism of a first embodiment of the inventive device, with the eye-forming station.
Figure 2:
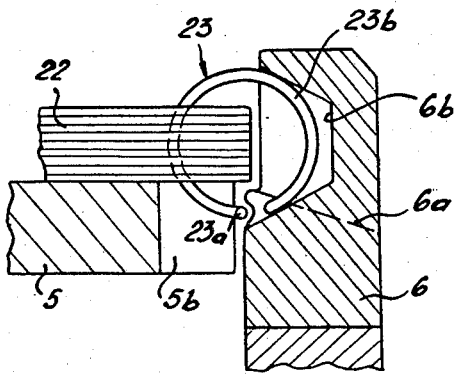
FIG. 2 is an enlarged vertical section of a detail of FIG. 1.
Figure 3:
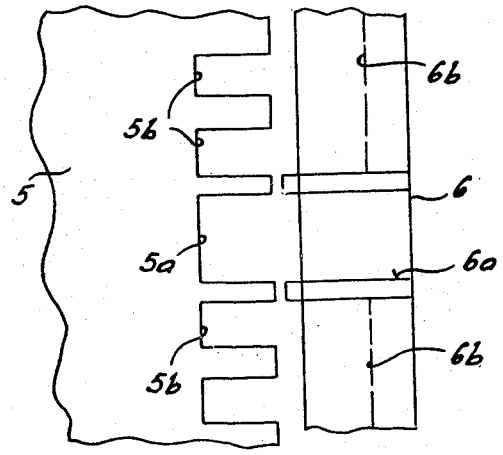
FIG. 3 is a top plan view corresponding to FIG. 2, without the bind.

Referring to the drawings in particular, the device shown in FIGS. 1 through 7*a*, comprises, a working table 1, with an eye-forming station 2. Parallel drivable conveyor belt 3 extend over working table 1 on either side of station 2, and drivable aligning rollers 4 are associated with station 2 and are provided at an adjustable distance above the conveyor belt and are carried by a pivoting arm 4*a*. In the zone of station 2, an incline 5 is provided which is slightly sloping relative to the plane of the table, and has a free front end projecting over the plane of the table, designed as a comb which is provided with a central recess 5*a* and a plurality of tooth spaces 5*b* at both sides thereof (FIG. 3). An abutment 6 pivotable about a horizontal cross-axis 6*c* cooperated with this comb edge 5*a*, 5*b* of incline 5 and comprises a recess 6*a* corresponding to recess 5*a*, and a receiving trough 6*b* in the zone of the tooth spaces 5*b*, which trough has a trapezoidal cross-section. As shown in FIG. 1, abutment 6 is spring-loaded by spring 6*d* and is biased in the clockwise direction about axis 6*c*. FIG. 3 thus shows the loop engagement comb means or first means of the invention.

Eye-forming station 2 of table 1 is associated with a tongs mechanism 7, whose axis 7*a* in the vertical longitudinal central plane through table 1, is slightly inclined. This tongs mechanism 7, which is supported through a guide housing or frame 8 on a support 9 which, in turn, is supported on table 1, comprises a cylinder 10 which is axially movable and rotatable in housing 8. Tongs mechanism 7 is supported by means of a collar or spool 10*a* and through rollers 11 guided in the collar, by a vertically pivotable lever 12. Collar 10*a* has a lower flange 10*b* and an upper flange 10*c*. The lower running surface for the rollers 11 of collar 10*a* is provided, at two diametrically opposite locations of its circumference, with a small elevation 13*a* which corresponds to a recess 13*b* in the upper running surface of collar 10*a*.

Figure 6:
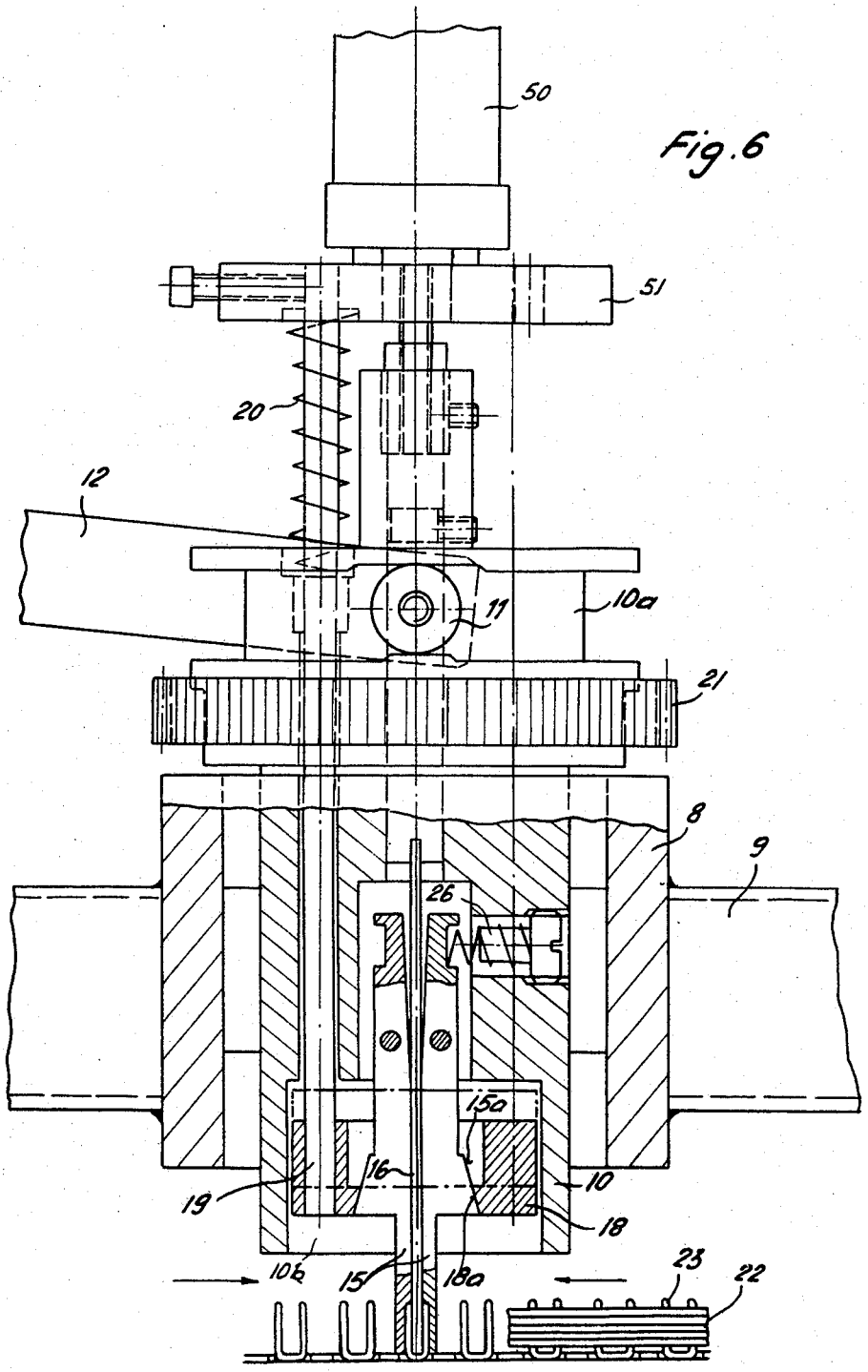
FIG. 6 is a partial sectional view of the tongs mechanism according to FIG. 4 in the closed, lowered position of the tongs.

Two arms 15, 15 of the tongs are pivotally mounted by means of cross-pins 14 in this cylinder 10. The downwardly projecting clamping jaws of the tongs are biased by springs 26 in the opening direction of the tongs. Only one of the springs is shown in FIG. 6. A tongue 16 fixed in the core of cylinder 10 is disposed between the two tong arms 15. Arm 12 with cylinder 10 and rollers 11 thus form third means in the invention for bringing the tong jaw into the area of the stack edge recess.

Figure 4A:
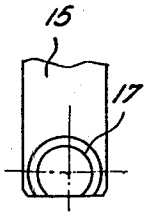
FIG. 4*a* is a view showing the inside of a tong arm.
Figure 5:
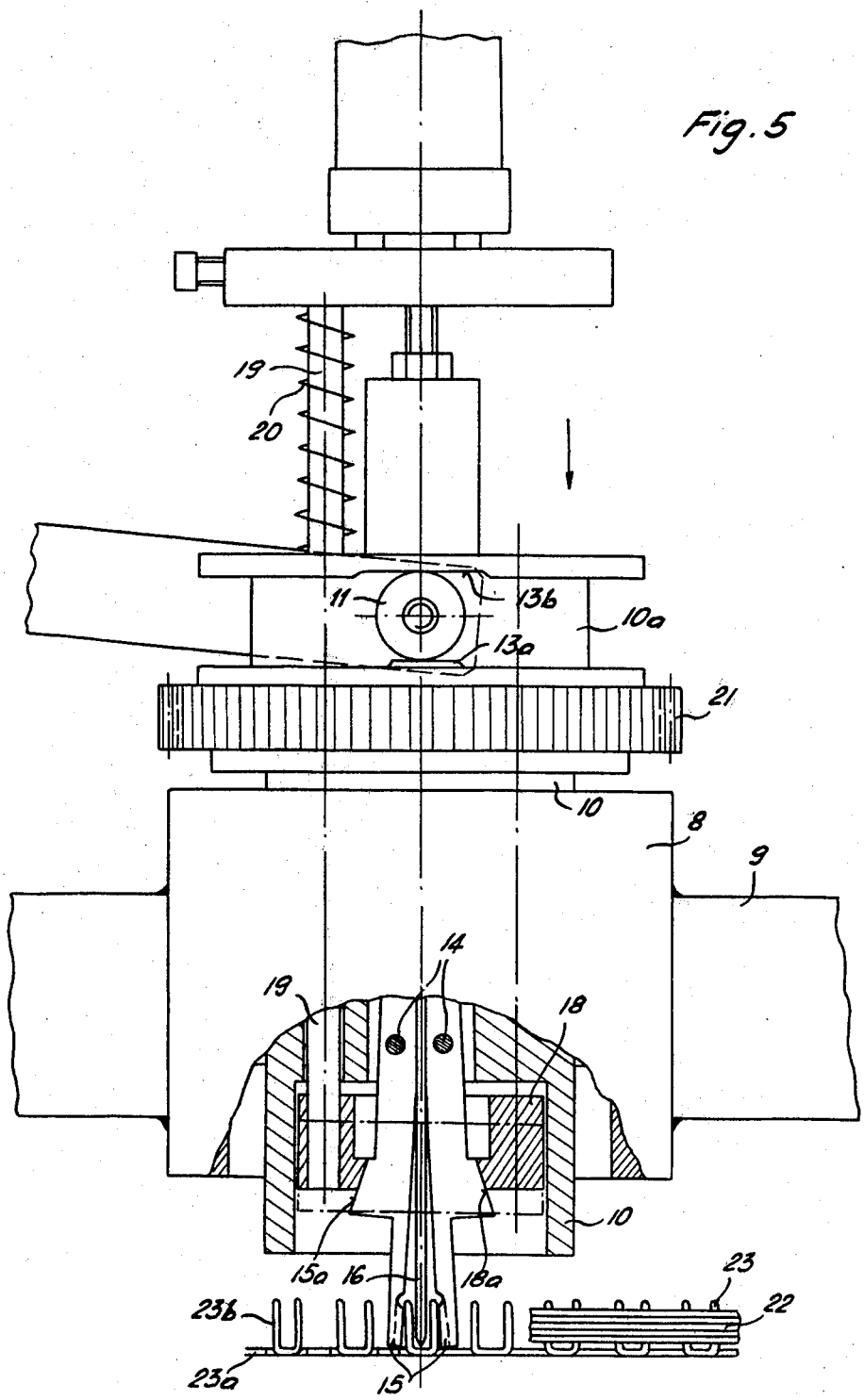
FIG. 5 is a partial sectional view of the tongs mechanism according to FIG. 4 in the open, lowered position of the tongs.

Each of the insides of clamping jaws of tong arms 15 is provided with a circular groove 17 (FIG. 4*a*) extending through almost 360°, the depth and width of which correspond approximately to the diameter of a wire loope 23*b* serving to form a binding 23 (FIG. 2 and FIG. 5). A hollow closing piston 18 (FIG. 6) is guided in a recess 10*b* of cylinder 10 and its bore is provided with flared surfaces 18*a* which cooperate with corresponding tapered surfaces 15*a* provided on tong arms 15. The hollow piston 18 is secured to an actuating rod 19, extending upwardly through a bore cylinder 10 and movable downwardly from a position of disengagement under the action of a spring 20, which bears against the cylinder collar 10*a*. This forms the second means of the invention for opening and closing the jaw.

A toothed rim 21 is provided, below collar 10*a*, on the cylindrical portion projecting from housing 8, and this rim meshes with a toothed rack mounted for reciprocating motion (not shown). This is the fourth means for rotating the closed tong jaw in accordance with the invention.

Figure 9:
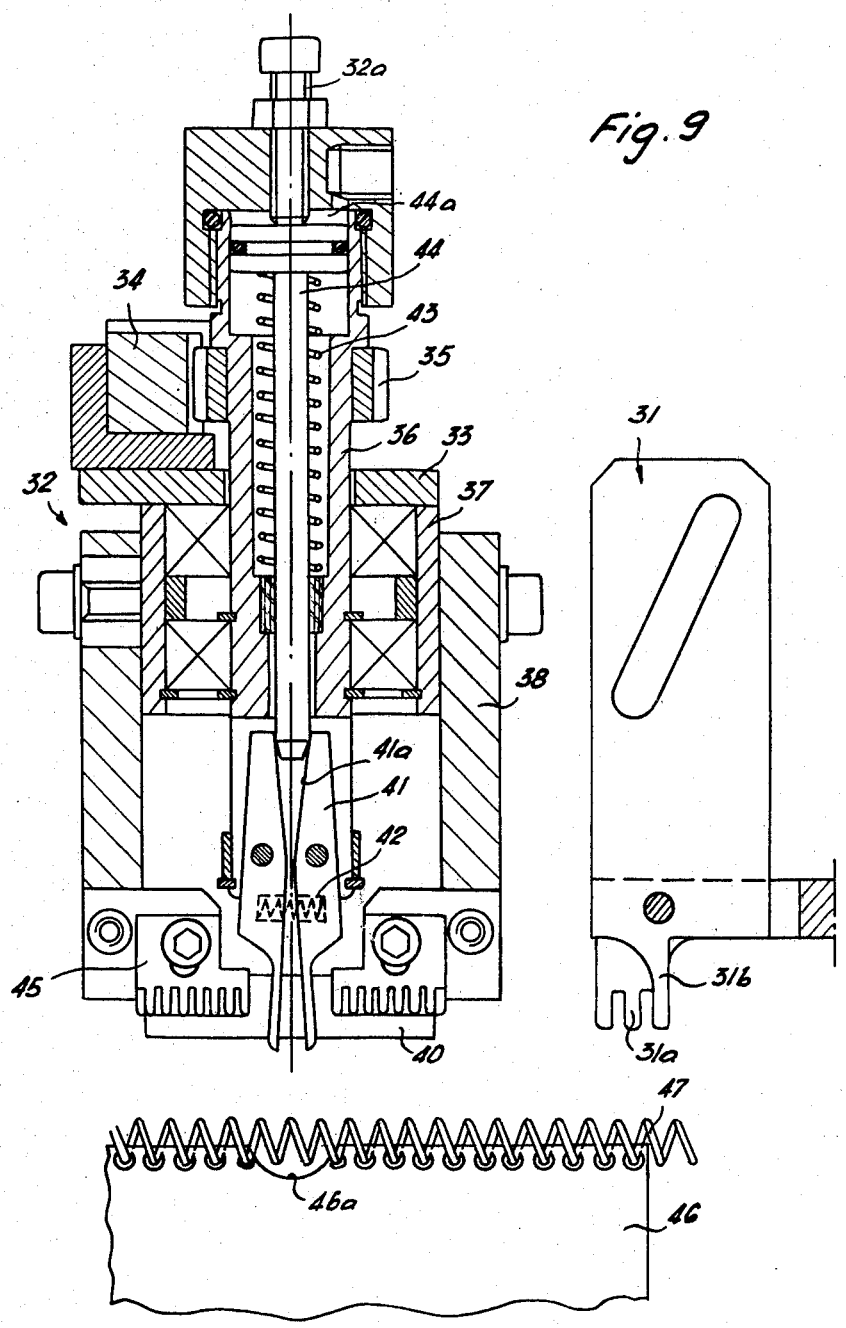
FIG. 9 is a vertical cross-section of the device of FIG. 8 in the rest position.

Suitable driving mechanisms of a known type are provided for conveyor belt 3, roller 4, supporting arm 12 of the cylinder, tooth rim 21, and hollow piston 18 and are coupled to each other in such a manner that the following manufacturing operations may be carried out during the operation of the described device:

In a conventional manner (not shown), sheet packs 22, for example, calendars, are bound by means of a comb-like wire structure 23 having longitudinal portions 23*a* and circular double wire-loops 23*b* transversely bent out therefrom. The loops 23*b* pass through holes provided near one edge of the sheet pack, for example, the top edge. At this edge, a substantially semi-circular recess is provided near the center of the pack so that the loops 23*b* extend freely in this area. A similar recess 46*a* is shown in FIG. 9, in connection with another embodiment of the invention. With their bind 23 in the leading position, the calendars 22 pass in the advancing direction (arrow a in FIG. 1), to coneyor belt 3, where they are taken along by dogs 3*a* provided on the belts and fed one after the other into the eye-forming station 2.

Figure 4:
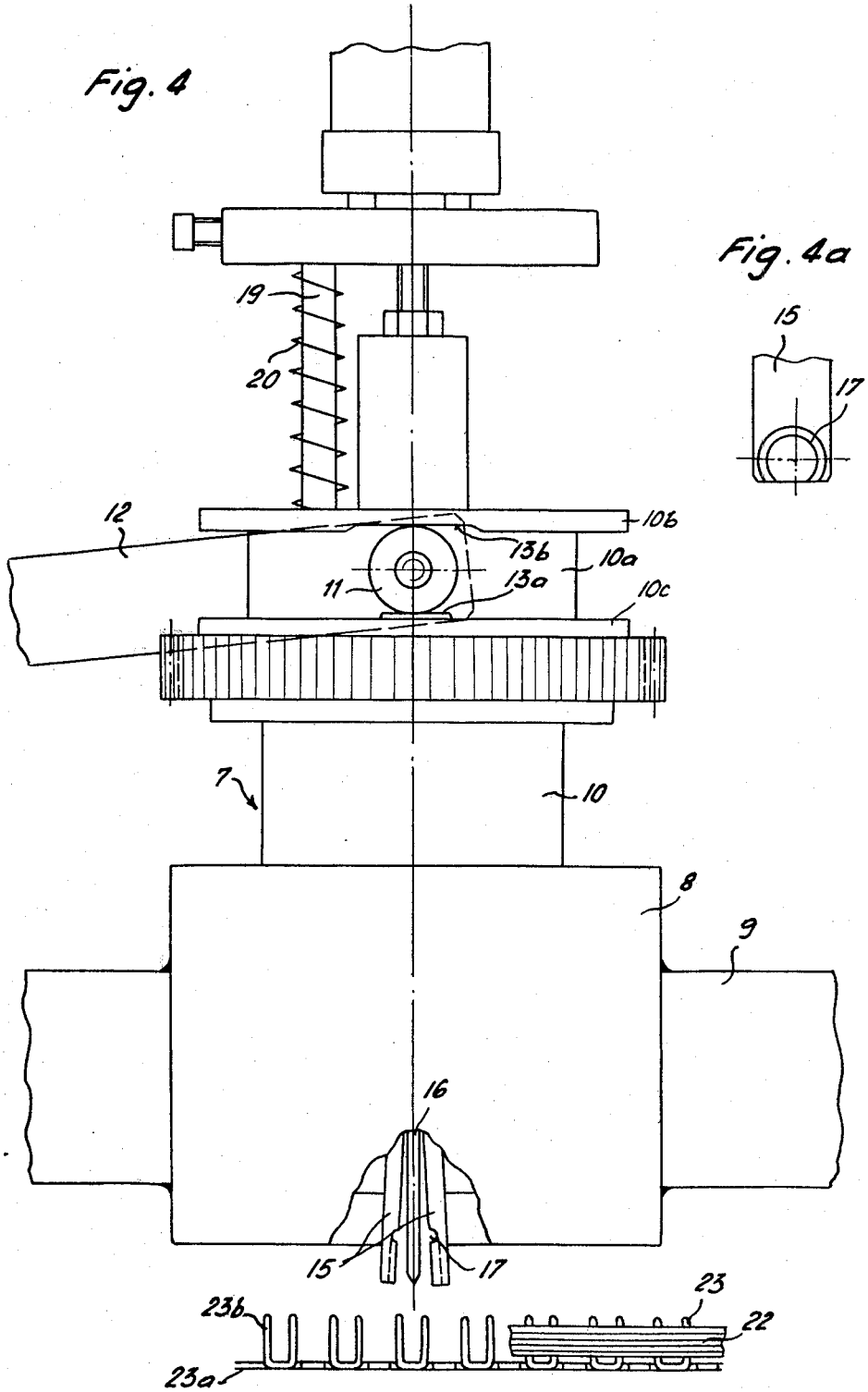
FIG. 4 is a front view of the tongs mechanism of the first embodiment in rest position, that is, with the tongs open and lifted.

During this feeding phase, cylinder 10 and its tongs 15 are in their rest position, shown in FIG. 4. Tongs 15 are open and abutment member 6 is in its tilted-back position indicated in dotted lines in FIG. 1, due to the bias of spring 6*d*. As soon as the bind or binder structure 23 of an advanced calendar 22 passes below rollers 4, which are rotated in the direction of arrow b, the rollers cause a rotary motion of this bind about its axis until link portions 23*a* are in a bottom position (FIG. 2). This is, in practice, they apply against the lowermost sheet of the calendar and the free ends of the loops project downwardly.

As a calendar 22 passes on incline or platform 5 and comes with its top edge equipped with the bind 23, into the range of the comb-like edge of the inclines, link portions 23*a* of bind 23 come into a position in front of the front side of the incline, while loops 23*b* penetrate into comb spaces 5*a*, 5*b*.

Conveyor belts 3 are stopped and, simultaneously, abutment 6 is tilted into its vertical position so that it receives loops 23*b* in its trough 6*b* and, at the same time, presses link portions 23*a* of bind 23 against the front side of incline 5. The loop 23*b* which is provided in the zone or area of the recess in the top edge of the calendar, extends in recess 6*a* of abutment 6 and is thus freely accessible from above. Due to the engagement of the loops in the comb spaces 5*b* of incline 5 and to the clamping effect of abutment 6 on link portions 23*a*, and with trough 6*b* of abutment 6 engaging over the bind also partly from above, the bind with the link portions extending at the bottom is secured against both rotation about its axis and against lateral and vertical displacement.

In the course of these operational steps, the tongs mechanism 7, guided in housing 8, is in its upper rest position, shown in FIG. 4, and the tongs are open, with the cylinder 10 being in such a rotary position that rollers 11 apply against elevations 13*a* in flange 10*c* of cylinder collar 10*a*; tongue 16 of the tongs is in a position above the center of a loop 23*b*, to be formed into a hanger eye, while the two spread-apart clamping jaws of the tong arms are in a positive above the spaces of the bind adjacent this loop.

By means of lever 12, cylinder 10, along with the open tongs 15, is moved downwardly (FIG. 5) until the tongs practically completely engages over the loop to be formed into the eye, while tongue 16 extends between the two wire portions of the loop. Then, advantageously, by pneumatic pressure in a piston-cylinder arrangement 50 and plate 51, for example, hollow piston 18 is lowered in the cylinder by means of rod 19, whereby, due to the wedging engagement of surfaces 18*a* and 15*a*, tongs 15 is closed (FIG. 6). Because of circular grooves 17 in the clamping jaws of the tongs, and due to the tongue 16 extending between the two wire portions of the loop gripped by the tongs, the loop becomes somewhat narrower, but is not deformed, in spite of the firm grip.

Figures 7, 7A:
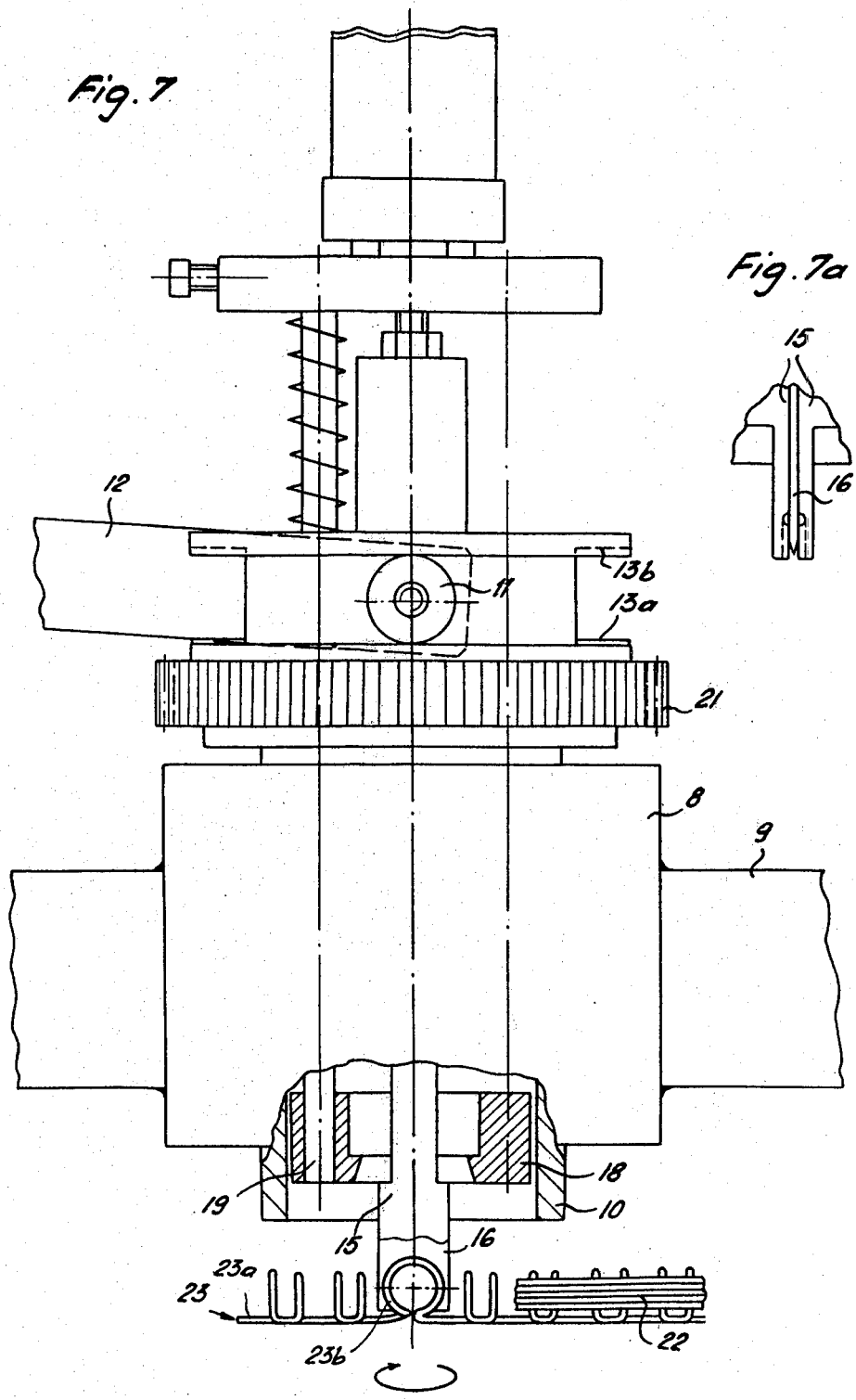
FIG. 7 is a view similar to FIG. 6 with the tongs in the closed, turned position.
FIG. 7*a* is a front view of the closed tongs.

In a following operational step, the loop gripped by the tongs is twisted through 90°. For this purpose, cylinder 10 is turned by means of tooth rim 21 through 90°. Due to this motion, rollers 11 are disengaged from elevations 13*a* or recesses 13*b* of the running surfaces of cylinder collar 10*a*, which results in a correspondingly easy lifting of cylinder 10 and thus, of tongs 15 (FIG. 7). This causes a slight lifting of loop 23*b* so that the twisting of the loop is facilitated without an undesirable strong loading of the adjacent wire link portions.

Immediately thereafter, rod 19 is relieved so that, due to the action of spring 20, hollow piston 18 releases tongs 15 and their clamping jaws open (FIG. 7). Thereby, loop 23*b* which has been bent out of its initial plane through 90°, is again exposed, and cylinder 10, along with open tongs 15, can be lifted by pivoting lever 12. Thereupon, cylinder 10 is moved back into its initial rotational position (FIG. 4), by means of tooth rim 21.

Abutment 6 is not tilted back again so that it disengages from bind 23. Abutment 6 may be moved by drive means 60, using a cylinder 61 with a piston 62 and cam 63, as shown. Conveyor belts 3 are again set in motion and remove calendar 22 from the eye-forming station while, at the same time, the next calendar with its bind passes to this station, and another working cycle begins. In the described manner, the hanger eye of a calendar bind may be produced continuously.

In the foregoing, the forming of a hanger eye on a binder having double wire loops was treated. A quite analogous method may also be used with binders which are formed of a wire helix. FIGS. 8 through 12 show such a device with which a binder may be provided with a single loop hanger eye.

Figure 8:
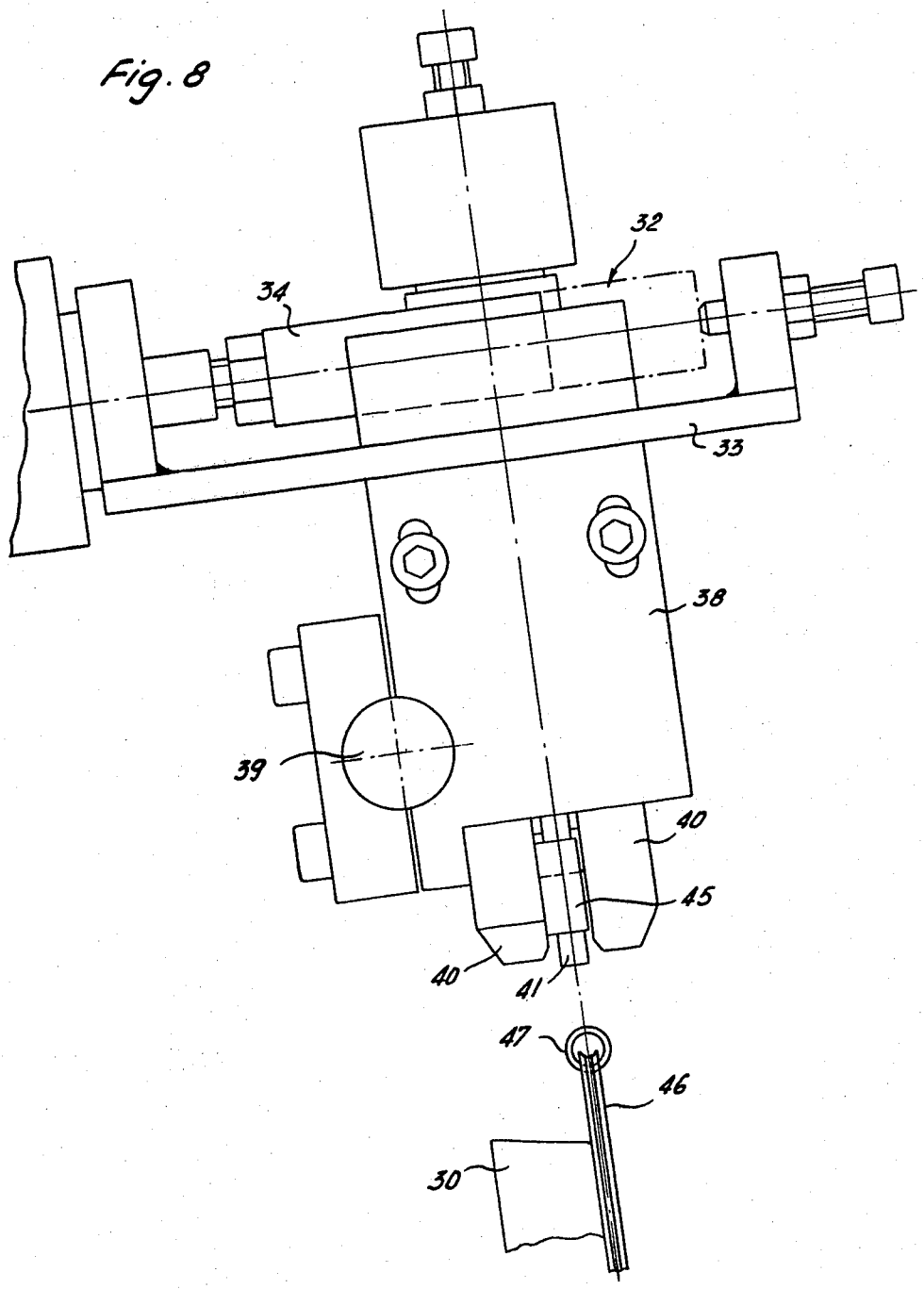
FIG. 8 is a side elevational view of the tongs mechanism of another embodiment of the inventive device.

The side view of FIG. 8 shows a device, comprising, a supporting plate 30, which is slightly inclined relative to the vertical, and on which the sheet packs to be bound, for instance, calendars, may be placed in a position fixed by suitable stops and with their top edge already provided with the holes (46*b* in FIG. 9) and a center recess (46*a* in FIG. 9) turned upwardly.

In a conventional manner, which has not been shown, a wire formed into a helix (47 in FIG. 9) is introduced into the mentioned holes by a known winding device and is cut off, from an infed wire.

In addition to utilizing the known winding device, the inventive device includes a known bending device 31, provided adjacent ends of the top edge of the calendars and which is adjustable to the size of the calendars, of which only one is shown in FIGS. 9 through 12, while a tongs mechanism 32 is provided between the bending devices. This tongs mechanism which can be lifted and lowered along with the bending mechanism as a whole, comprises a supporting arm 33 on which a tooth rack 34 is guided which is mounted for reciprocating motion transversely to the axis 32*a* of the tongs mechanism 32, and is driven, for instance, pneumatically.

Rack 34 meshes with a pinion 35 which is secured to a hollow shaft 36 which is mounted for rotation on a bushing 37 which, in turn, is fixed to side plates 38 and is axially adjustable. Plates 38, which are horizontally displaceable to a limited extent, are mounted on a supporting shaft 39 which can be lifted and lowered. The lower edge portions of plates 38 are connected to each other by two spaced apart stops 40 which project downwardly. The spacing of the stops 40 approximately corresponds to the diameter of the wire helix loops.

Tongs 41, 41 project between these stops 40 and the arms of the tongs are mounted for pivoting on a shaft 36 and in the plane of the calendar. The tong arms are biased by a spring 42, in the opening direction. An actuating rod 44 projects between the tapering surfaces 41*a* of tongs arms 41 and is guided in shaft 36 against the action of a spring 43 from an upper rest position downwardly, and preferably, under pneumatic drive, as mentioned, which can be applied into space 44*a*. Two comb plates 45, which are adjustable in height, are secured on both sides of the working ranges of the tongs clamping jaws and between stops 40. The spacing between teeth corresponds to half the spacing of the turns of the wire helix 47, serving as the binder of calendar 46, so that every second tooth space can receive one turn of the helix.

The eye-forming method, with the described device, is carried out as follows:

FIG. 9 shows the rest position of the device after the wire helix 47 passing through the holes in the top edge end of the sheet pack has been produced. Tongs mechanism 32 and cutting and bending devices 31 are in their upper starting position, that is, they are lifted from the top of the calendar. In a first operational step, devices 31 and 32 are lowered into their working position with the wire helix 47 coming between the two stops 40, while the comb plates 45, on both sides of the open tongs 41, engage into the wire helix loops, placed therebelow. The same applies to comb plates 31*a* of bending devices 30 so that the binder of the calendar, placed on support 30, is secured against both axial displacement and a motion perpendicularly to the plane of the calendar.

Figure 10:
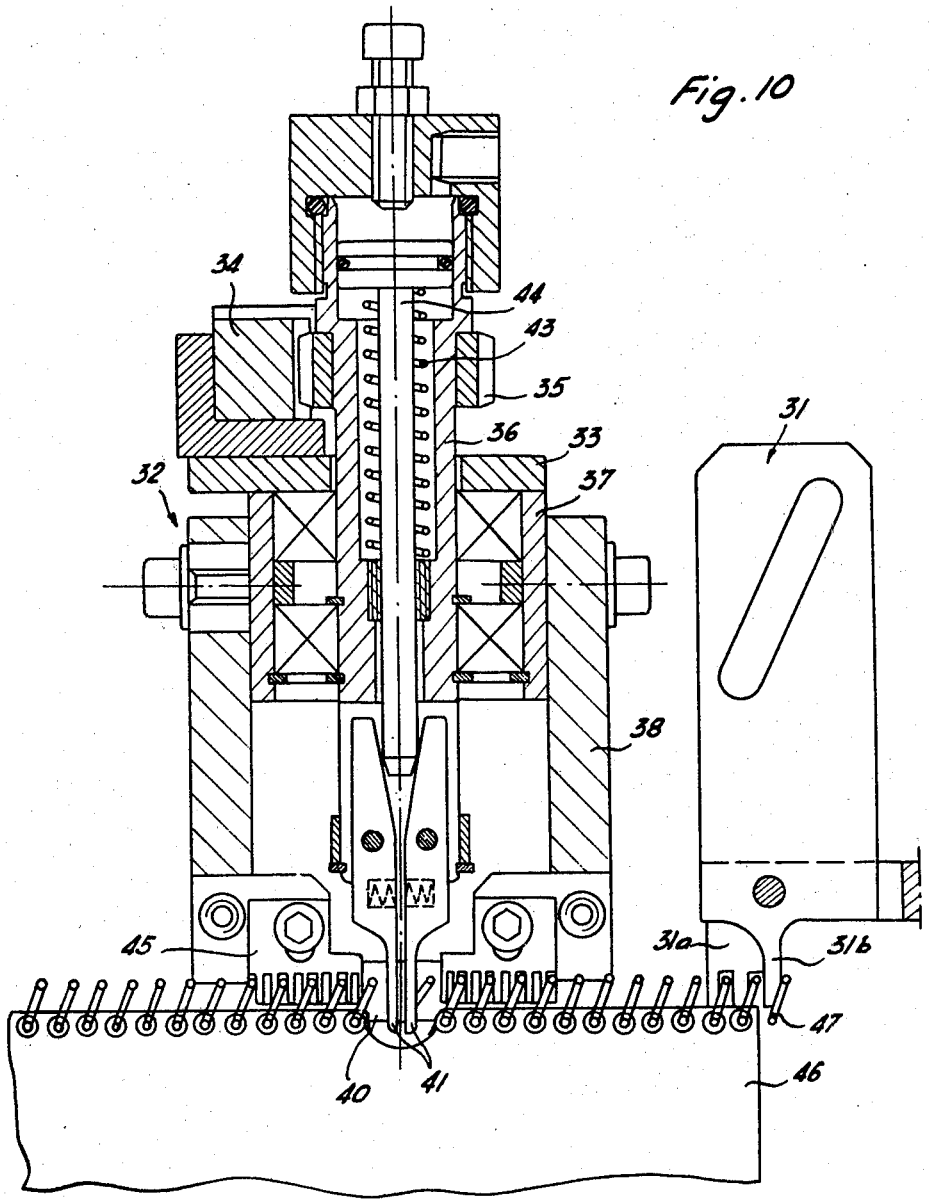
FIG. 10 is a cross-section, similar to FIG. 9, of the device with the tongs in closed and lowered positions.

At the same time, the clamping jaws of open tongs 41 have engaged over one of the freely extending wire turns in the recess 46*a* on the top edge of the calendar. Actuating rod 44 is now pushed down in the direction against the action of spring 43, whereby, due to the engagement with tapering surfaces 41*a*, the tongs is closed (FIG. 10). The clamping jaws of the tongs engage over the wire turn extending therebetween.

Figure 11:
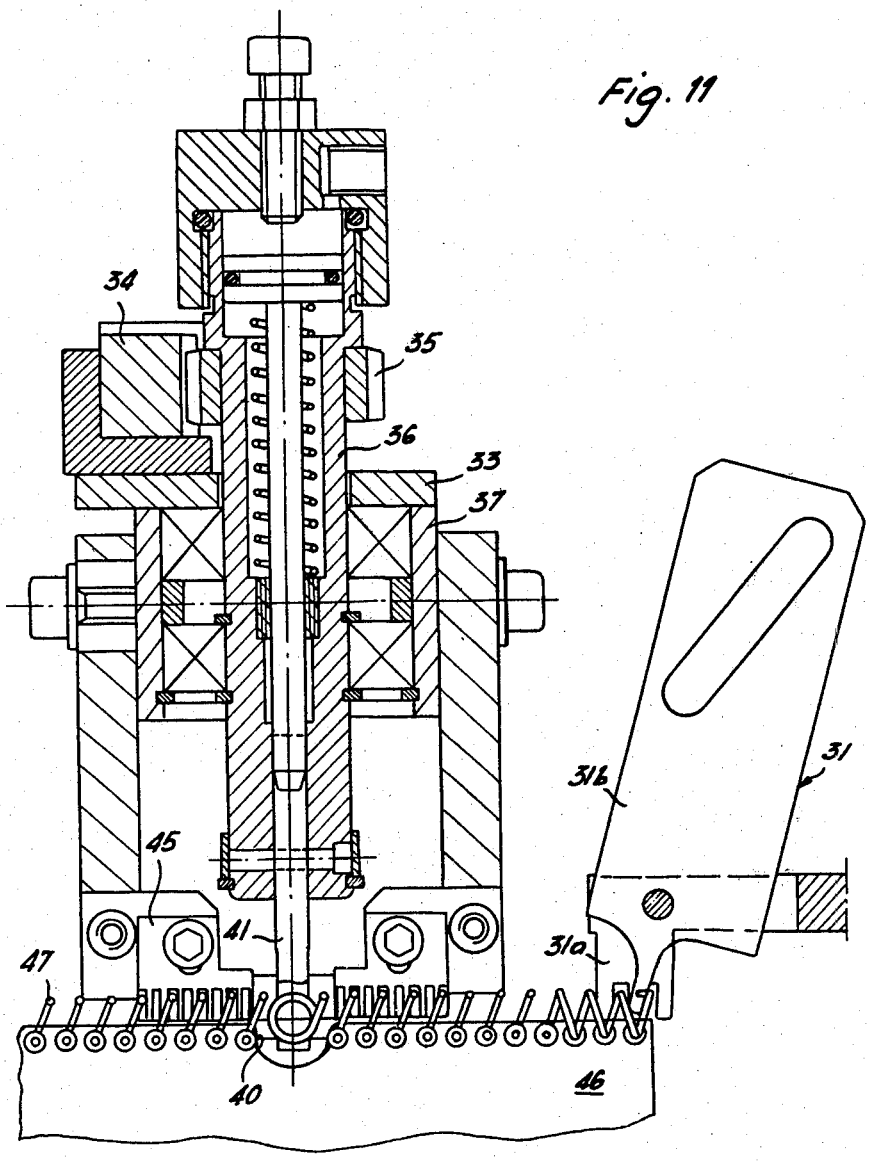
FIG. 11 is another sectional view of the device of FIG. 8, similar to FIG. 10, with the tongs in closed and turned positions.
Figures 12, 12A, 12B:
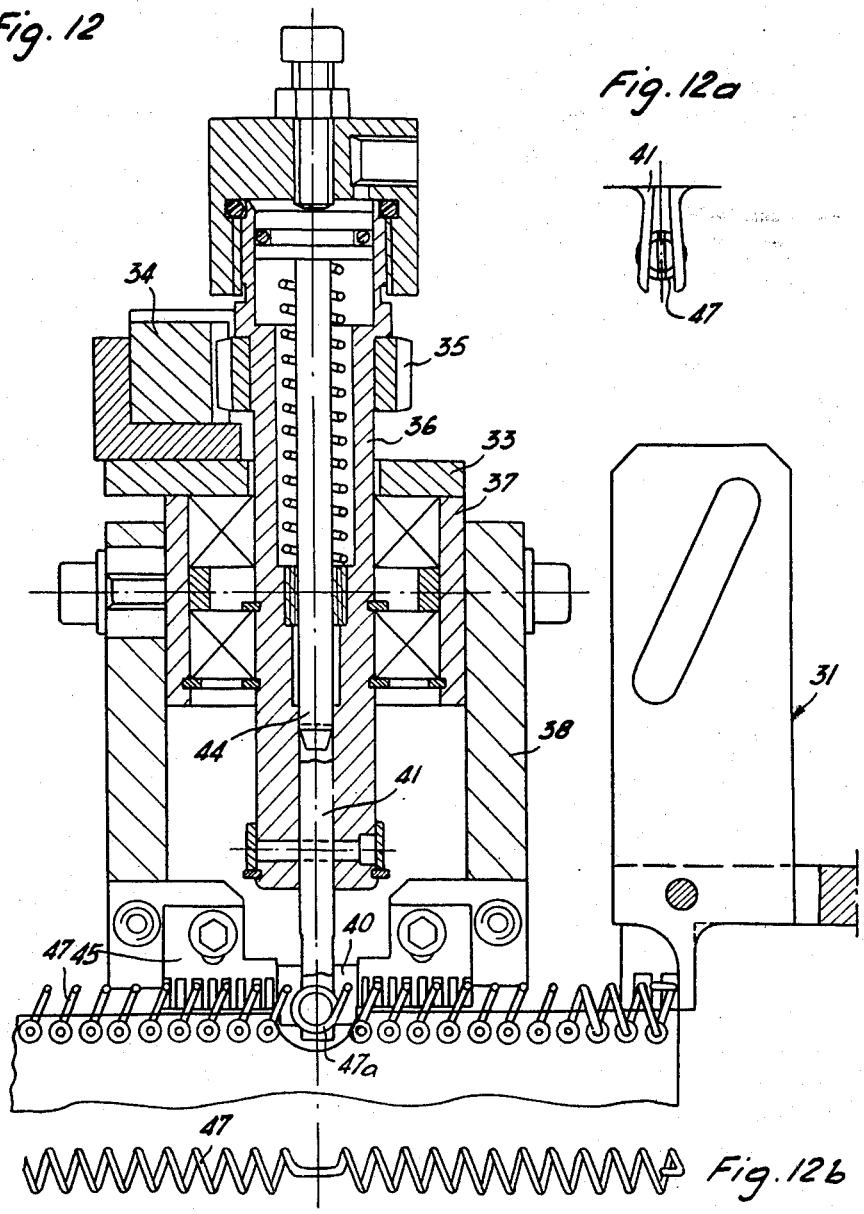
FIG. 12 is a sectional view, similar to FIG. 11, of the device of FIG. 8, with the tongs, still turned, but in an open position.
FIG. 12*a* is a view of the open, turned tongs according to FIG. 12.
FIG. 12*b* is a top plan view of the finished binding.

Subsequently, on the one hand, shaft 36 carrying tongs 41 is turned through 90° by tooth rack 34 and pinion 35 while, on the other hand, bending tool 31*b* of bending device 31 is pivoted inwardly (FIG. 11). This results in a corresponding twisting of the turn gripped by tongs 41 into the plane of the calendar and in a bending inwardly and parallel with the axis of the free ends of wire helix 47. Now, due to the action of springs 43, 44, tongs 41 is opened by receiving rod 44 and, at the same time, the cutting and bending tools 31*b* are pivoted back into their initial position. Thereupon, device 31, 32 is lifted from the calendar into its rest position and shaft 36, with tongs 41, is turned back through 90°, into its initial position. The calendar whose binder is now provided with a hanger eye 47*a* (FIG. 12) is removed and a new, not yet bound calendar, is inserted, so that a new working cycle may begin.

Due to a corresponding time control, the individual working steps follow each other automatically without having to provide any additional manual operations during the time between the feeding of the non-bound sheet pack up to the removal of the finished and bound pack provided with a hanger eye.

The methods and devices described make it possible to not only automatically produce in series the sheet pack binder provided with an integral hanger, but also ensures a reproducible twisting of this wire loop to shape, particularly due to the provision that all of the wire portions adjacent the wire loop to be deformed are fixed.

As a matter of course, wire binds of the kind in question, of any size, can be provided with hanger eyes, in accordance with the described methods. By exchanging a few parts, for example, the comb elements, the abutments and the tong arms, the described devices may be adapted to different sizes of the binder in a simple manner. Since the tongs mechanism can be easily removed as a whole, the same machine may also be used for providing sheet packs with wire binders without the hanger eye.

While specific embodiments of the invention have been shown and described in detail to illustrate the application of the principles of the invention, it will be understood that the invention may be embodied otherwise without departing from such principles.

I claim:

1. A method of forming a hanger eye in a wire binding comprising the steps of: forming a plurality of parallel loops in a continuous wire, each extending through a stack of sheets adjacent one edge thereof to bind the stack of sheets together; forming a recess in the one edge of the stack of sheets having at least one loop therein which does not extend through the stack of sheets; supporting the bound stack with the recess exposed; providing a pair of tongs forming a loop-clamping jaw which can be closed to grasp a loop; moving the tongs into the recess in a direction perpendicular to the edge of the stack and around at least one loop within the recess; closing the jaw to grasp the at least one loop in the recess; rotating the jaw with grasped loop to rotate the loop approximately 90° in the recess and form a hanger eye; opening the jaw to release the loop now in the form of a hanger eye; and moving the tongs away from the recess in a direction perpendicular to the stack eye.

2. A method, as claimed in claim 1, further including forming the continuous wire into a plurality of parallel axially aligned link portions connected by double wire loops extending substantially perpendicular to the parallel link portions with the double wire loops extending through the stack of sheets to form the bound stack, at least one double wire loop being disposed in the recess, providing a moving conveyor belt, providing a hanger eye-forming station at one position along the movement of the conveyor belt having comb engagement and clamping means therein for firmly engaging and immobilizing the plurality of loops at the hanger eye-forming station, positioning the bound stack of sheets on the moving conveyor belt to move the bound stack of sheets with its recess into the eye-forming station, grasping the plurality of loops with the comb engagement and clamping means, the jaw grasping at least one double wire loop to form the hanger eye therewith, and slightly withdrawing the double wire loop to be rotated, and further permitting the bound stack of sheets with formed hanger eye to move with the moving conveyor belt and away from the eye-forming station to permit a succeeding bound stack to be moved on the moving conveyor belt.

3. A method, as claimed in claim 1, wherein the continuous wire is formed into a helix with loops extending through the stack of sheets, providing a gripping comb means for grasping and immobilizing the plurality of loops and bending opposite ends of the continuous wire helix at opposite ends of the stack of sheets inwardly and parallel to the axis of the edge of the stack of sheets.

4. A device for forming a hanger eye in a continuous wire binding having a plurality of loops extending through a stack of sheets adjacent one edge thereof with a recess formed in the edge, comprising, a frame, a pair of tongs movably mounted in the frame forming a jaw for grasping at least one loop in the area of the recess, first means engageable with the wire binding for fixing the plurality of loops with respect to the edge of the stack of sheets, second means connected to said pair of tongs for opening and closing said jaw to release and grasp the at least one loop, third means connected to same frame for moving said frame and said jaw into the vicinity of the recess in the stack edge, and fourth means connected to said pair of tongs for rotating said jaw when it has been moved into the vicinity of the recess by said third means and closed by said second means to rotate the at least one loop by about 90° to form the hanger eye.

5. A device, as claimed in claim 4, further including a conveyor belt for moving a plurality of the stacks with binders along a feed path and bring each binder into an eye-forming station, said first means for fixing the plurality of loops with respect to the stack edge, comprising, a platform having a comb formation adjacent the eye-forming station having a central recess for receiving loops of the binder in the vicinity of the stack edge recess and tooth spaces on either side of said central recess for receiving the plurality of loops in the binder, an abutment member pivotally mounted adjacent said platform, said abutment having at one end thereof a trough for receiving the plurality of loops facing said comb formation and driving means connected to said abutment for pivoting said abutment trough into engagement with a binder in the eye-forming station to immobilize the binder between said trough and said comb formation.

6. A device, as claimed in claim 4, further including a tongue extending between said pair of tongs for extending between two adjacent loops in a binder formed of a plurality of double wire loops and connecting linking sections, said jaw provided for clamping two adjacent loops with said tongue therebetween.

7. A device, as claimed in claim 5, further including a driven alignment roller rotatably mounted above the conveyor and adapted to engage the binding as it passes on said conveyor to rotate the binding through a frictional contact therewith and reposition the links connecting the double wire loops to abut against the side of the stack of sheets.

8. A device, as claimed in claim 7, wherein said abutment member further includes an abutment surface movable toward said comb formation for clamping the connecting links of the binder at said eye-forming station.

9. A device, as claimed in claim 4, wherein said third means for moving said jaw into the area of the recess comprises a cylinder rotatably and axially movable in said frame, said cylinder including upper and lower flanges, at least one roller riding between said upper and lower flanges, a support arm pivotally mounting said roller and movable with said roller to move said cylinder toward and away from the area of the recess in the stack edge, said pair of tongs pivotally mounted to said cylinder and extending outwardly from the end thereof.

10. A device, as claimed in claim 9, further including an elevation in said lower flange and a recess in said upper flange for displacing said cylinder downwardly as said cylinder rotates, said cylinder connected to said fourth means for rotating said jaw, and said cylinder moving upwardly through the action of said roller riding between said upper and lower flanges.

11. A device, as claimed in claim 9, including two of said rollers riding between said upper and lower flanges of said cylinder both pivotally mounted to said support arm and diametrically opposite each other between said upper and lower flanges.

12. A device, as claimed in claim 4, wherein said second means for opening and closing said jaw comprise said pair of tongs, each including an outer tapered surface, a hollow cylinder mounted around said pair of tongs and in said frame for axial movement having a flared inner surface engageable with said tapered outer surface of said tongs, and drive means connected to said hollow position for moving said hollow piston axially with respect to said pair of tongs to close said pair of tongs with biasing means connected to said pair of tongs for biasing said jaw toward its open position.

13. A device, as claimed in claim 12, wherein said drive means for moving said hollow piston, comprise, a rod connected between said hollow piston and said frame and a spring biasing said rod to move said hollow piston in a direction to open said jaw.

14. A device, as claimed in claim 4, wherein said fourth means comprises a pinion connected to said pair of tongs and a rack movably mounted with respect to said frame and engaged with said pinion for rotating said pinion and said pair of tongs.

15. A device, as claimed in claim 4, further including a bearing bushing mounted in said frame, a shaft rotatably mounted in said bearing bushing carrying said pair of tongs, said pair of tongs being pivotally mounted to said shaft, said tongs including inwardly facing inclined surfaces and biasing means for biasing said jaw into its open position, a rod slidably mounted in said shaft and movable between said inclined surfaces to close said jaw, and pneumatic means connected between said rod and said frame for moving said rod downwardly to close said jaw.

16. A device, as claimed in claim 4, wherein the binding is formed of a continuous helical wire, further comprising, a support for supporting the stack of sheets with its binding in a position to expose the recess and the plurality of loops, a pair of stops extending from said frame and movable with said frame into a position on either side of said plurality of loops, a pair of comb plates positioned on either side of said jaw having teeth for receiving said plurality of loops on either side of the recess in said stack edge.

17. A device, as claimed in claim 16, further including bending tools on either side of said frame for bending the wire inwardly at opposite ends of the bound stack of sheets.

* * * * *